US008931179B2

(12) United States Patent
Powell

(10) Patent No.: US 8,931,179 B2
(45) Date of Patent: Jan. 13, 2015

(54) INTERLOCKING DOUBLE THROWING KNIFE

(76) Inventor: Marc Powell, Georgetown, TX (US)

( * ) Notice: Subject to any disclaimer, the term of this patent is extended or adjusted under 35 U.S.C. 154(b) by 544 days.

(21) Appl. No.: 13/211,891

(22) Filed: Aug. 17, 2011

(65) Prior Publication Data

US 2012/0304469 A1 Dec. 6, 2012

Related U.S. Application Data

(60) Provisional application No. 61/374,315, filed on Aug. 17, 2010.

(51) Int. Cl.
*B26B 11/00* (2006.01)
*B26B 3/00* (2006.01)
*B26B 29/02* (2006.01)

(52) U.S. Cl.
CPC ..... *B26B 3/00* (2013.01); *B26B 29/025* (2013.01)
USPC ..... 30/143; 30/151; 30/152

(58) Field of Classification Search
USPC ..... 30/143, 145, 146, 147, 148, 149, 150, 30/151, 152, 162, 125, 299, 340; D8/98, D8/99, 105
See application file for complete search history.

(56) References Cited

U.S. PATENT DOCUMENTS

| | | | | | |
|---|---|---|---|---|---|
| 301,976 | A * | 7/1884 | Forsyth | 30/143 |
| 766,059 | A * | 7/1904 | Palmer | 30/153 |
| 920,235 | A * | 5/1909 | Aagaard | 30/143 |
| 1,425,750 | A * | 8/1922 | Crawford | 30/148 |
| 1,814,547 | A * | 7/1931 | Edwards | 30/143 |
| 2,109,016 | A * | 2/1938 | Ringer | 30/143 |
| 2,820,291 | A * | 1/1958 | Philippar | 30/153 |
| 3,995,902 | A * | 12/1976 | Sciaino, Jr. | 294/5 |
| 4,047,298 | A * | 9/1977 | Philippar | 30/153 |
| 4,317,284 | A * | 3/1982 | Prindle | 30/340 |
| 4,330,937 | A * | 5/1982 | Cope | 30/153 |
| 4,364,174 | A * | 12/1982 | De Asis | 30/153 |
| 4,555,822 | A * | 12/1985 | Miceli | 7/119 |
| 4,608,757 | A * | 9/1986 | Eckerle | 30/299 |
| 4,893,408 | A * | 1/1990 | Mattingly et al. | 30/123.5 |
| 5,310,229 | A * | 5/1994 | Hanson | 294/26 |
| 6,195,898 | B1 * | 3/2001 | Lemisch | 30/153 |
| 6,401,341 | B1 * | 6/2002 | Hernandez | 30/136 |
| 6,848,183 | B2 * | 2/2005 | Lemisch | 30/153 |
| 2002/0144409 | A1 * | 10/2002 | Chen | 30/299 |
| 2008/0016699 | A1 * | 1/2008 | Chang | 30/151 |
| 2009/0100683 | A1 * | 4/2009 | Lion et al. | 30/138 |
| 2012/0042520 | A1 * | 2/2012 | Simeray | 30/143 |
| 2012/0304469 | A1 * | 12/2012 | Powell | 30/143 |

* cited by examiner

*Primary Examiner* — Hwei C Payer
(74) *Attorney, Agent, or Firm* — Yudell Isidore PLLC

(57) ABSTRACT

An interlocking double throwing knife comprises: a first opposable throwing knife having a first blade and a first handle attached to the first blade, where the first handle has a first receptacle for housing another blade; and a second opposable throwing knife having a second blade and a second handle attached to the second blade, where the second handle has a second receptacle for housing another blade. The first opposable throwing knife and the second opposable throwing knife interlock by simultaneously inserting the first blade into the second receptacle and the second blade into the first receptacle such that the first blade and the second blade are sheathed within opposing knife handles.

26 Claims, 8 Drawing Sheets

INTERLOCKING DOUBLE THROWING KNIFE

PRIORITY

The present invention takes priority from provisional patent application, Ser. No. 61/374,315 filed on Aug. 17, 2010. The entire content of that provisional application is incorporated herein by reference.

BACKGROUND

1. Technical Field

The present invention relates in general to knives and in particular to throwing knives.

2. Description of the Related Art

Throwing knives are well known in the art as a single use weapon. Since many throwing knives (especially double ended throwing knives and throwing stars) require the user to hold a sharp blade by the hand as the user performs the throwing motion, improper throws can result in injury to the thrower. Additionally, because these knives have very sharp blades, a special casing or sheath has to be designed to enable the owner to carry the knife around. Unless holstered in some way, these cases typically make it difficult to quickly access the knife in the event of a sudden need to retrieve and throw the knife. Most throwing knives are thrown handle first, with the thrower holding and then releasing the exposed blade section of the knife. When holstered, retrieval from the holster can only be performed by the knife handle, and the thrower thus has to then change his holding position on the knife from the handle to the blade in order to be able to position the knife to be thrown at a target. In a close combat situation, this results in time wasted, which can be the difference in the outcome of such combat. Regardless how skilful a thrower may be, that skill is of little use if he cannot access the knife quickly, without cutting himself, and place the knife in the proper throwing position (blade before handle) to effectively hoist and throw the knife towards an assailant or other general target.

Additionally when using a throwing knife as a weapon, the throwing knife is considered a single use weapon since, once the knife is thrown, the knife is typically unreachable or unrecoverable and is thus no longer available to the user. This becomes problematic, particularly in a combat situation where there is an approaching assailant. Thus, where the user only has a single throwing knife at his disposal, throwing the knife leaves the user without a weapon and vulnerable. This issue is further complicated if the intended target was missed. While carrying multiple of these individual throwing knives is an option, carrying multiple individual knives can be cumbersome and adds difficulty when trying to safely holster and carry around the multiple knives, when the knives are not being used.

SUMMARY

Disclosed is an interlocking double throwing knife. The interlocking double throwing knife comprises a first opposable throwing knife and handle and a second opposable throwing knife and handle that are interlocked together, with the blades sheathed and held in place adjacent to each other within the opposing knife handle via a locking mechanism. The locking mechanism of the interlocking double throwing knife keeps the two opposable throwing knifes interlocked, adjacent to each other, within the opposing handles, which abut at their respective bases to create a single continuous handle structure that can be gripped from either end, masking/hiding the presence of blades. The blades remain interlocked within the abutting handles until a sufficient forward momentum is applied to the assembly to dislodge one of the two opposable throwing knifes, while the handle of the other opposable throwing knife is held by a user. The rotational force and forward momentum applied to the structure, while holding the knife handle of the first or the second opposable throwing knife are transferred from the user to the opposing second or first opposable throwing knife handle, resulting in release of the locking mechanism and the discharge of the second or first opposable throwing knife in accordance with the forward momentum. When the handle of the first opposable throwing knife is held or gripped by the user while performing the throwing motion, the first opposable throwing knife remains in the user's hand, with blade exposed, after launching of the second opposable throwing knife in the direction of the target, and vice versa.

In one embodiment, the blades are constructed from a ferrous material and the interlocking mechanism comprises one or more magnets embedded within the handle of each knife and which exert a magnetic force of the blade of the opposing knife when the blades are sheathed within the opposing handles to prevent the knives from being dislodged fro the sheathed position without sufficient forward momentum applied while one of the handles are being gripped by the thrower. The handles are constructed with a recessed space running in a longitudinal direction from the base of the handle to a point just before the top of the handle, within which the opposing blade can be inserted. The one or more magnets can be located along one or both sides of this recessed space, in one or more embodiments.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The present disclosure will best be understood by reference to the following detailed descriptions of illustrative embodiments when read in conjunction with the accompanying drawings, wherein.

DETAILED DESCRIPTION OF AN ILLUSTRATIVE EMBODIMENT

Figure 1A:
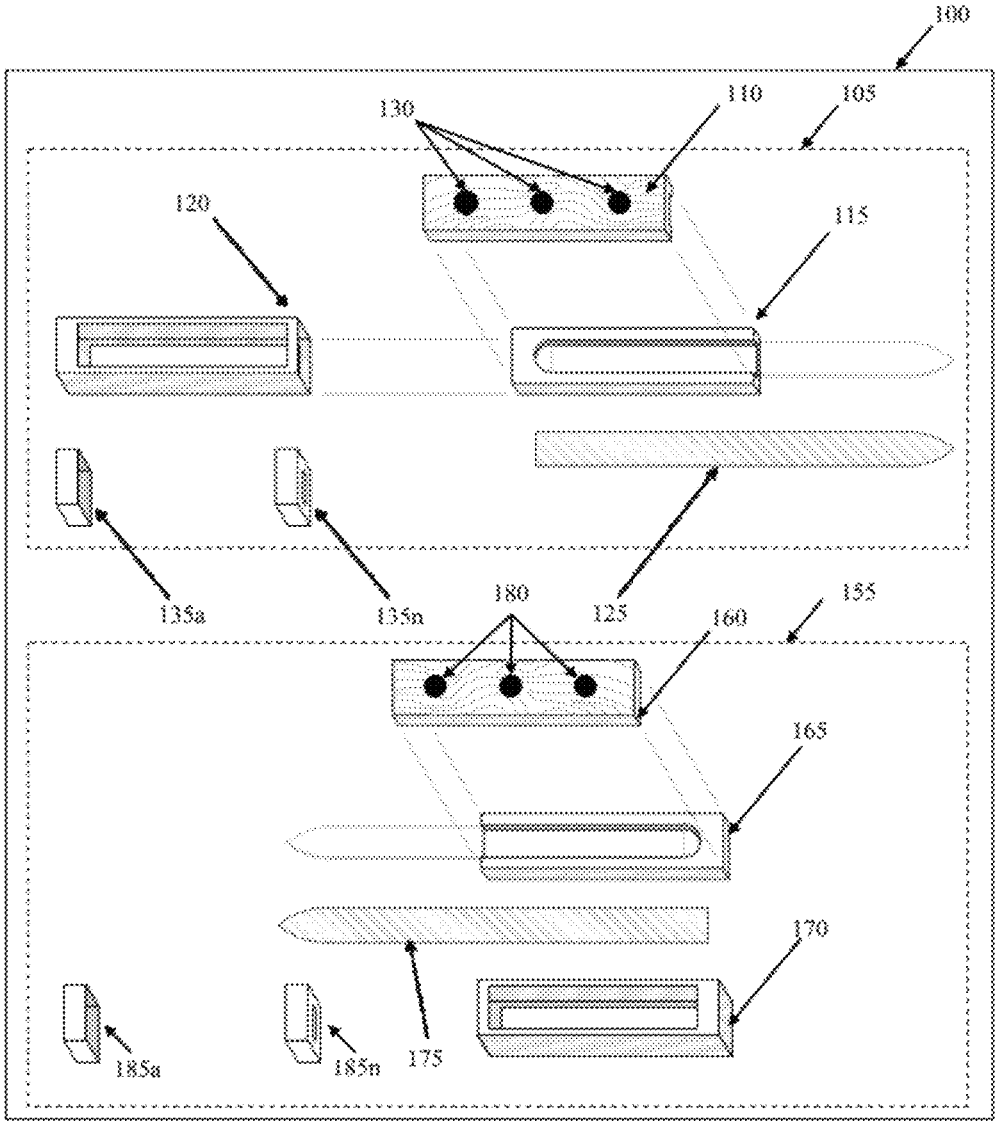
FIGS. 1A-C provide exploded views of assembly diagrams illustrating several methodologies for assembling components to create a first and a second knife for use within an interlocking double throwing knife, according to various embodiments of the invention.

The illustrative embodiments provide an interlocking double throwing knife, in accordance with one embodiment. The interlocking double throwing knife comprises a first opposable throwing knife and handle and a second opposable throwing knife and handle that are interlocked together, with the blades sheathed and held in place adjacent to each other within the opposing knife handle via a locking mechanism. The locking mechanism of the interlocking double throwing knife keeps the two opposable throwing knives interlocked, adjacent to each other, within the opposing handles, which abut at their respective bases to create a single continuous handle structure that can be gripped from either end, masking/hiding the presence of blades. The blades remain interlocked within the abutting handles until a sufficient forward momentum is applied to the assembly to dislodge one of the two opposable throwing knives, while the handle of the other opposable throwing knife is held by a user. The rotational force and forward momentum applied to the structure, while holding the knife handle of the first or the second opposable throwing knife are transferred from the user to the opposing second or first opposable throwing knife handle, resulting in release of the locking mechanism and the discharge of the second or first opposable throwing knife in accordance with the forward momentum. When the handle of the first opposable throwing knife is held or gripped by the user while performing the throwing motion, the first opposable throwing knife remains in the user's hand, with blade exposed, after launching of the second opposable throwing knife in the direction of the target, and vice versa.

In one embodiment, the blades are constructed from a ferrous material and the interlocking mechanism comprises one or more magnets embedded within the handle of each knife and which exert a magnetic force of the blade of the opposing knife when the blades are sheathed within the opposing handles to prevent the knives from being dislodged fro the sheathed position without sufficient forward momentum applied while one of the handles are being gripped by the thrower. The handles are constructed with a recessed space running in a longitudinal direction from the base of the handle to a point just before the top of the handle, within which the opposing blade can be inserted. The one or more magnets can be located along one or both sides of this recessed space, in one or more embodiments.

In the following detailed description of exemplary embodiments of the invention, specific exemplary embodiments in which the disclosure may be practiced are described in sufficient detail to enable those skilled in the art to practice the disclosure, and it is to be understood that other embodiments may be utilized and that architectural, mechanical, and other changes may be made without departing from the spirit or scope of the present disclosure. The following detailed description is, therefore, not to be taken in a limiting sense, and the scope of the presented embodiments is defined only by the appended claims.

It is understood that the use of specific component, device and/or parameter names are for example only and not meant to imply any limitations on the invention. The embodiments may thus be implemented with different nomenclature/terminology utilized to describe the components/devices/parameters herein, without limitation. Each term utilized herein is to be given its broadest interpretation given the context in which that term is utilized.

Figure 1B:
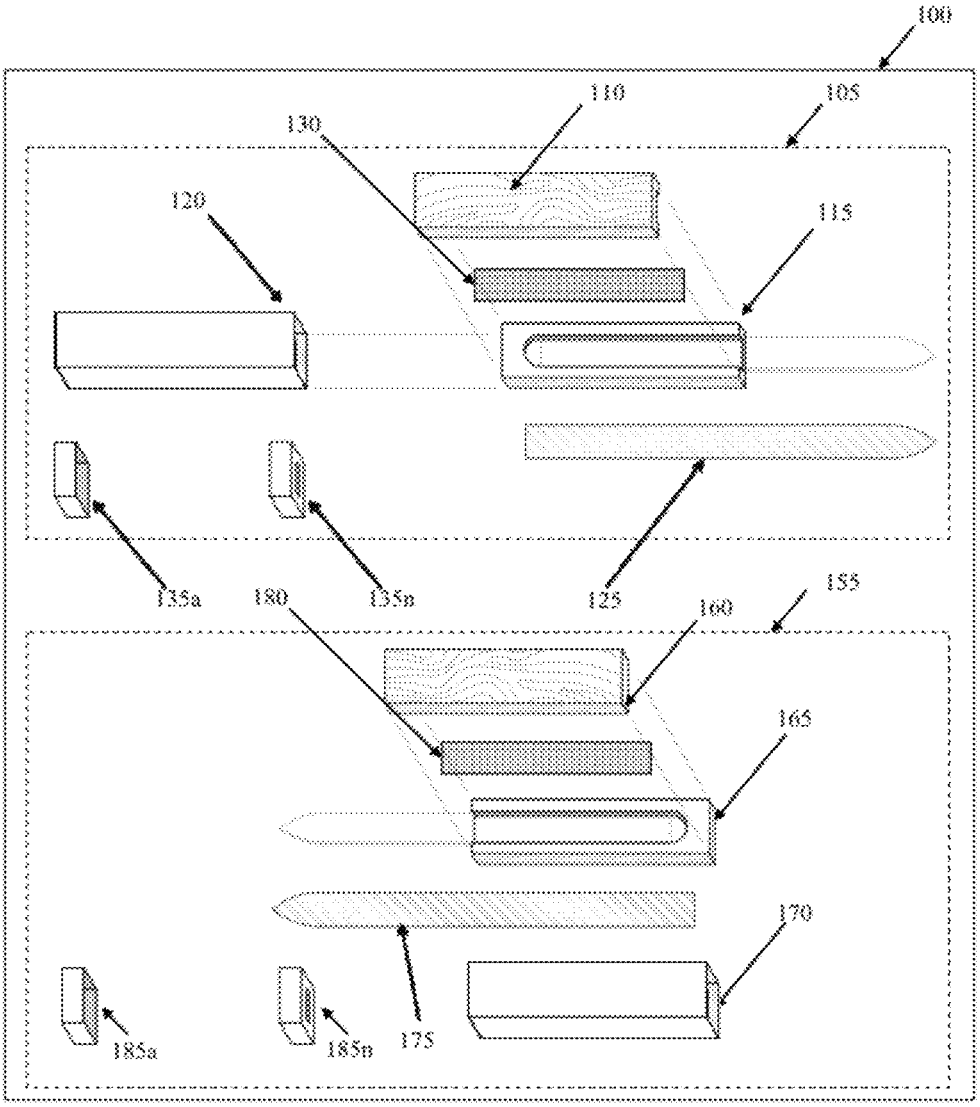
Figure 1C:
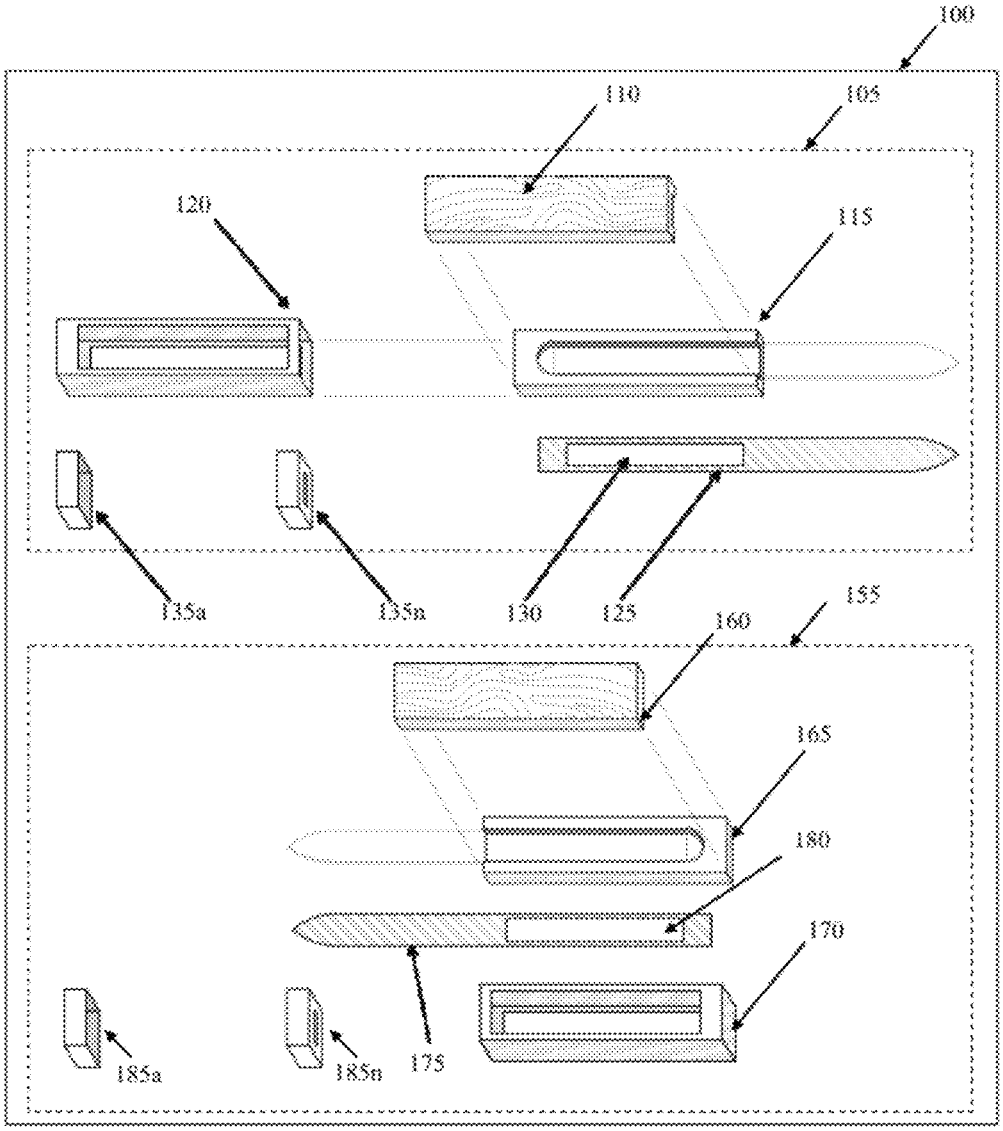

With reference now to FIGS. 1A-1C, and with particular reference to FIG. 1A, there are depicted exploded views of the assembly of both halves (first and second throwing knives) of an interlocking double throwing knife 100, according to one or more embodiments. It is appreciated that the assembly of the knife can be different and include use of different sub-components and different materials, etc., and the presented embodiments are merely for illustration of one possible method for assembling the knives. Referencing FIG. 1A, interlocking double throwing knife 100 is comprised of first opposable throwing knife 105 and second opposable throwing knife 155, both having a similar component makeup, design and structure.

First opposable throwing knife 105 includes a top handle portion 110 and a bottom handle portion 115 that together form the handle for the first opposable throwing knife 105. When assembled, the handle provides a base, which is the surface closest to the exposed blade, a top surface, which is the surface opposed to the base, and a body extending longitudinally from the top surface to the base. Viewable within the base of the top handle is a rectangular notch that is the beginning of an indentation that runs longitudinally within the top handle 110 for a length that is approximately equal to the length of the exposed portion of blade 175 of the second throwing knife 155. In the described embodiments, the indentation is made to be a width, depth height, and length that allow the placement of the exposed end of blade 175 within the handle of first throwing knife 105. When first throwing knife 105 is assembled, top handle 110 permanently affixed (e.g., by welding together) to bottom handle 115. Thus, when assembled, the handle of first throwing knife 105 provides a space, via the indentation, within which the exposed blade of the second throwing knife can be completely housed. This space is interchangeably referred to herein as a sheath for the opposing knife blade. Additional functional aspects of the handle are described in greater detail below. First throwing knife 105 also comprises a locking mechanism 130 that is illustrated as being a part of top handle portion 110, although locking mechanism can also be disposed in other sections of the handle. In one or more embodiments, the locking mechanism comprises strong ferrous magnets that are fixably inserted into one or both sections of the handle.

Additionally, first throwing knife 105 comprises a blade 125, which includes a handle section, fixably inserted within the bottom handle 115, and an exposed section, extending from the base of the handle. In a preferred embodiment, blade 125 is constructed from an extremely durable metal, such as steel, a metal alloy, or a forged metal. In several of the described embodiments, blade 125 is described as a ferrous material, which is a representation that blade 125 possesses qualities of durability and strength, as well as magnetism. The requirement that blade 125 be made of a material that exhibits magnetic properties is directly related to the type of locking mechanism 130 employed in the particular design of the interlocking double throwing knife 100.

As shown, blade 125 is fixably inserted/placed and permanently secured within bottom handle 115 during assembly and/or manufacture of first throwing knife. In one embodiment blade 105 may be welded into bottom handle 115, where the handle is itself made of a metal to which the blade can be welded. Alternative embodiments can provide for the blade 125 to be welded or fixably inserted into top handle 110. In yet another embodiment, blade can be fabricated as an extension of the top or the bottom handle using a single continuous metal molding, such that the blade and handle are constructed from a single fabrication process. It is appreciated that even with a single fabrication process, the exposed blade section of the knife can be forged with certain different qualities from the handle section by addition of specific substrates during the foundry process.

As shown, the blade 125 can have a double-tapered pointed end or may alternatively be single-tapered or have a special type of edge, as is well known in the art (e.g., a serrated edge). The non-pointed end of blade 125 is seated within top handle 110 in a slightly off-centered position so that when first opposable throwing knife 105 and second opposable throwing knife 155 are interlocked, there is adequate space for the blades to be inter-sheathed within the handle of the other opposable throwing knife. That is, within the sheathed arrangement of interlocking double throwing knife 100, blade 125 operates as a male connector that inserts within the "female" opening receptacle or space formed within the handle of second opposable throwing knife 155. Thus, the handle of the first throwing knife provides a female receptacle for housing blade 175 of second throwing knife.

Top handle 110 and a bottom handle 115 can be both constructed from a same type of material. This material may be any metal (e.g., steel, iron, or aluminum), a durable plastic, wood, or any other suitable material. In a preferred embodiment the material is lightweight but very durable and can withstand multiple impacts of the knife blade hitting and penetrating into different types of targets. In one embodiment, top handle 110 and bottom handle 115 are joined together by a welding process. In another embodiment, top handle 110 and bottom handle 115 may be secured together by screws, where top handle 110 and bottom handle 115 have a number of screw holes along the perimeter of the handles for inserting a screw into one of the top handle 110 and bottom handle 115 that penetrates through to the other handle to securely lock the top handle 110 and bottom handle 115 together. In yet another embodiment, top handle 110, bottom handle 115, and blade 125 may be a single molded piece. Additionally, top handle 110 and bottom handle 115 may be secured together by an optional outer sheath 120 and/or one or more optional locking rings 135*a*, 135*n*. The locking rings 135*a*, 135*n* can be inserted and/or affixed over the base and the top surface of the handle to complete the construction of the handle. In one or more embodiments, an adhesive, such as glue, can be utilized to secure the sheath and the locking rings to the assembled handle. In one embodiment, the outer sheath 120 and optional locking rings 135*a-n* can be provided for one or more of aesthetic appearance and improving the grip and/or weight characteristics of the knife handle. Blade 125, top handle 110, and bottom handle 115 may be constructed from the same or different materials, including different materials from respective blade 175, top handle 160, and bottom handle 165 of second opposable throwing knife 155.

While the perimeter shape of top handle 110 and bottom handle 115 are illustrated with squared-off edges, in another embodiment the top handle 110 and bottom handle 115 may have rounded edges or may have an oval or diamond shape, among others. In one embodiment, the shape of the handle may be molded with finger grips and/or indentations that provide a more secure grip for a user of the interlocking double throwing knife 100. The exterior surface of top handle 110 and bottom handle 115 may also be painted in a desired color or be affixed with a design, logo, or text. The top handle 110 and bottom handle 115 may also have inlaid sub-sections of a second material which may be a different type of material (e.g., fabric, metal, plastic, or ivory) from the material used in construction of top handle 110 and bottom handle 115. This material may provide an increased grip on the handle by a user or may be provided purely for aesthetic purposes. In yet another embodiment, top handle 110 and bottom handle 115 may be partially or completely wrapped in this different type of material.

Optional outer sheath 120 provides an additional holding surface that is secured over top handle 110 and bottom handle 115. Outer sheath 120 may be made of a different material than top handle 110 and bottom handle 115. Outer sheath 120 also provides additional tactile texture when holding first opposable throwing knife 105. As provided above, outer sheath 120 may also be utilized to keep top handle 110 and bottom handle 115 secured together. Outer sheath 120 may be shaped such as to cover the entire handle of only a portion of first opposable throwing knife 105. Further, the shape of outer sheath 120 may be textured with a slip-resistant material or molding or molded with finger grips and/or finger indentations that provide a more secure grip for a user when the forward momentum is applied to the first opposable throwing knife 105. Outer sheath 120 may also be painted in a desired color or be affixed with a design, logo, or text. Outer sheath 120 may also have inlaid sub-sections of a second material which may be a different type of material (e.g., fabric, metal, plastic, or ivory) from the material used in construction of top handle 110, bottom handle 115, or blade 125. This material may provide an increased grip on outer sheath 120 by a user or may only be for aesthetic purposes. In yet another embodiment top handle 110 and bottom handle 115 may be partially or completely wrapped in this different type of material.

Optional locking rings 135*a-n* provide additional security for keeping top handle 110 and bottom handle 115 of the first opposable throwing knife 105 secured together. Locking rings 135*a-n* may also secure over optional outer sheath 120, if applicable.

First opposable throwing knife 105 also has locking mechanism 130 which provides a method which to hold first opposable throwing knife 105 and second opposable throwing knife 155 in place when interlocked. In the described embodiments, locking mechanism 130 is one or more magnets strategically placed within receptacles of top handle 110 and/or bottom handle 115. The magnets provide a ferromagnetic polarity opposite to the ferromagnetic polarity of blade 175 of the opposing knife, resulting in a magnetic attraction. This magnetic attraction of top handle 110 and/or bottom handle 115 with blade 175 keeps first opposable throwing knife 105 and second opposable throwing knife 155 interlocked. FIG. 1A illustrates locking mechanism 130 as a series of 3 magnets inserted within holes provided in top handle 110.

In another embodiment, the locking mechanism may include mechanical components or a mechanical mechanism embedded within top handle 110 and/or bottom handle 115 for keeping first opposable throwing knife 105 and second opposable throwing knife 155 interlocked, such as a tooth of one handle that locks into a groove of the opposite blade or the opposite handle. In another embodiment locking mechanism 130 may comprise optional locking rings 135*a-n* and/or optional outer sheath 120. In yet another embodiment, locking mechanism 130 may be a safety latch or a subcomponent thereof, such that a male or female component 126, 127 of the safety latch is attached or embedded within top handle 110 and/or bottom handle 115 of first opposable throwing knife 105 and the opposite male or female component 126, 127 is attached or embedded within top handle 160 and/or bottom handle 165 of second opposable throwing knife 155.

As illustrated by FIGS. 1A-1C, second opposable throwing knife 155 can be similarly constructed as first opposable throwing knife 105, but as a mirror image with respect to the location of the knife blade along the handle and the indentation within the handle that is utilized to sheath the exposed blade 125 of first throwing knife 105. Thus, second throwing knife 155 includes a top handle 160 and a bottom handle 165 that together form the handle for the second opposable throwing knife 155. Second throwing knife also comprises a blade 175 and a locking mechanism 180. Similar to blade 125, blade 175 is constructed from an extremely durable metal, such as steel, a metal alloy, or a forged metal, and the blade 175 may be welded into top handle 160 or bottom handle 165. Also, the blade 175 may have a double-tapered pointed end (as illustrated) or may alternatively be single-tapered or have a special type of edge, as is well known in the art (e.g., a serrated edge). The non-pointed end of blade 175 is fixably seated within top handle 160 in a slightly off-centered position so that when second opposable throwing knife 155 and first opposable throwing knife 105 are interlocked, there is adequate space for the blades to be inter-sheathed within the handle of the other opposable throwing knife.

Top handle 160 and bottom handle 165 together form a handle of second opposable throwing knife 155, and also provide the indentation or space for housing blade 125. Top handle 160 and a bottom handle 165 can both be constructed from a same type of material. This material may be any metal (e.g., steel, iron, or aluminum), a plastic, wood, or any other suitable material. In a preferred embodiment the material is lightweight but very durable. In one embodiment, top handle 160 and bottom handle 165 are joined together by a welding process. In another embodiment top handle 160 and bottom handle 165 may be secured together by screws, where the perimeter of top handle 160 and bottom handle 165 have a number of screw holes for inserting a screw into one of the top handle 160 and bottom handle 165 that penetrates through to the other handle to securely lock the top handle 160 and bottom handle 165 together. In yet another alternate embodiment, top handle 160, bottom handle 165, and blade 175 may be a single molded piece. Additionally, top handle 160 and bottom handle 165 may be secured together by an optional outer sheath 170 and/or one or more optional locking rings 185*a-n*. While not preferred, it is also contemplated that a less durable version of the interlocking double throwing knife 100 can be constructed with some form of adhesive or bonding utilized to secure the top and bottom handles together and potentially other parts of the individual knives (105/155). Blade 175, top handle 160, and bottom handle 165 may be constructed from the same or different materials, including different materials from respective blade 125, top handle 110, and bottom handle 115 of first throwing knife 105.

While the perimeter shape of the top handle 160 and bottom handle 165 are illustrated with squared edges, in another embodiment the top handle 160 and bottom handle 165 may have different shaped edges. In one embodiment, the exterior shape, and look and feel, of the handle of the second throwing knife 155 are substantially identical to those of the first throwing knife 105. This similarity in shape and look and feel between the knives 105 and 155 enables the interlocking double throwing knife 100 to appear to be a single baton-like structure, with just the handles visible as a contiguous structure. This enables the interlocking double throwing knife 100 to be appropriately disguised as an elongated baton and to be carried exposed to the general public as such. Alternate embodiments can provide for a different second throwing knife structure than the first throwing knife, where the two knives can still be interlocked, but present two halves that are distinguishable from each other when in the locked position. Of course, the exterior portions of the knives can be made to appear substantially similar, while the knives themselves are configured differently, e.g., with different types of blades and different weights and other functional characteristics.

As with the first throwing knife 105, the shape of the handle of the second throwing knife 155 can be molded with finger grips and/or finger indentations that provide a more secure grip for a user of the interlocking double throwing knife 100. The exterior surface of top handle 160 and bottom handle 165 may also be painted in a desired color or be affixed with a design, logo, or text. The top handle 160 and bottom handle 165 may also have inlaid sub-sections of a second material which may be a different type of material (e.g., fabric, metal, plastic, or ivory) from the material used in construction of top handle 160 and bottom handle 165. This material may provide an increased grip on the handle by a user or may utilized purely for aesthetic purposes. In yet another embodiment top handle 160 and bottom handle 165 may be partially or completely wrapped in this different type of material.

Optional outer sheath 170 provides an additional holding surface that is secured over top handle 160 and bottom handle 165. Outer sheath 170 may be made of a different material than top handle 160 and bottom handle 165. Outer sheath 170 also provides additional tactile texture when holding second opposable throwing knife 155. As provided above, outer sheath 170 may also secure to keep top handle 160 and bottom handle 165 together. Outer sheath 170 may be shaped such as to cover the entire handle of only a portion of second opposable throwing knife 155. Further, the shape of outer sheath 170 may be textured with a slip-resistant material or molding or molded with finger grips and/or finger indentations that provide a more secure grip for a user when the forward inertial momentum is applied to the second opposable throwing knife 155. Outer sheath 170 may also be painted in a desired color or be affixed with a design, logo, or text. Outer sheath 170 may also have inlaid sub-sections of a second material which may be a different type of material (e.g., fabric, metal, plastic, or ivory) from the material used in construction of top handle 160, bottom handle 165, or blade 175. This material may provide an increased grip on outer sheath 170 by a user or may only be for aesthetic purposes. In yet another embodiment top handle 160 and bottom handle 165 may be partially or completely wrapped in this different type of material.

Optional locking rings 185*a-n* provide additional security for keeping top handle 160 and bottom handle 165 of the second opposable throwing knife 155 secured together. Locking rings 185*a-n* may also secure over optional outer sheath 170, if applicable.

Second opposable throwing knife 155 also has locking mechanism 180 which provides a method which to secure first opposable throwing knife 105 and second opposable throwing knife 155 when interlocked. FIG. 1A illustrates locking mechanism 180 as a series of 3 magnets inserted within holes in top handle 160. In the described embodiments, locking mechanism 180 is one or more magnets strategically placed within receptacles of top handle 160 and/or bottom handle 165 magnets that provide a ferromagnetic polarity opposite the ferromagnetic polarity of blade 125. This magnetic attraction of top handle 160 and/or bottom handle 165 with blade 125 keeps first opposable throwing knife 105 and second opposable throwing knife 155 interlocked. In another embodiment, the locking mechanism may include mechanical components or a mechanical mechanism embedded within top handle 160 and/or bottom handle 165 for keeping first opposable throwing knife 105 and second opposable throwing knife 155 interlocked, such as a tooth of one handle that locks into a groove of the opposite blade or the opposite handle. In another alternate embodiment locking mechanism 180 may be optional locking rings 185*a-n* and/or optional outer sheath 170. In yet another alternate embodiment locking mechanism 180 may be a safety latch or a subcomponent thereof, such that a male or female component of the safety latch is attached or embedded within top handle 160 and/or bottom handle 165 of second opposable throwing knife 155 and the opposite male or female component is attached or embedded within top handle 110 and/or bottom handle 115 of first opposable throwing knife 105.

The weight of the combined handle of each opposable throwing knife is designed such that the handle has a specific weight relative to the exposed blade in order to provide a balanced and predictable flight path of the released opposable throwing knife after the locking mechanism(s) have disengaged. The weight of the combined handle and the weight of the blade of each opposable throwing knife may also be designed in a specific proportion in order to control an amount of rotational momentum of the blade after the locking mechanism(s) have disengaged. The weight of the handle and of the blade of each opposable throwing knife is a calculated designed characteristic that allows each opposable throwing knife to be ideal for throwing at a remote target.

With reference now to FIG. 1B, there is depicted an interlocking double throwing knife 100, wherein locking mechanism 130 and locking mechanism 180 are single magnetic strips that are inserted on the blade-facing side of top handle 110 and top handle 160, respectively, in accordance with one embodiment. Also depicted in FIG. 1B are outer sheath 120 and outer sheath 170 both of which are shaped/molded to cover the entire handle of first opposable throwing knife 105 and second opposable throwing knife 155, respectively. An alternate embodiment provides the magnetic strips embedded within the exterior surface of the top handle 110/160 and/or the bottom handle 115/165.

With reference now to FIG. 1C, there is depicted an interlocking double throwing knife 100, wherein locking mechanism 130 and locking mechanism 180 are single magnetic strips affixed to handle portions of blade 125 and blade 175, respectively, in accordance with one embodiment. For wood based construction of the knife handles, it is contemplated that a less durable version of the interlocking double throwing knife 100 can be constructed with some form of adhesive or bonding utilized to secure the handles and other parts of each individual knife together.

Figure 2:
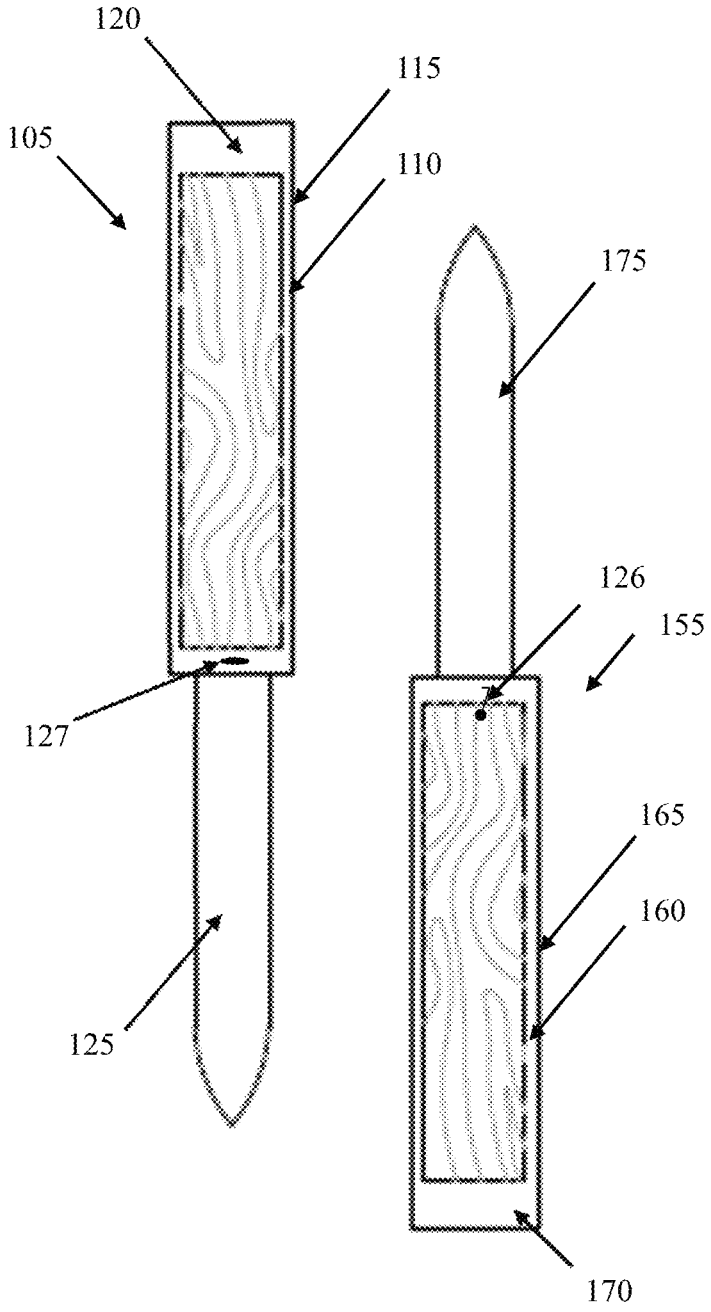
FIG. 2 is a top, side-by-side view of the first and second opposable throwing knives of the interlocking double throwing knife, according to one embodiment.

With reference now to FIG. 2, there is depicted a top, side-by-side view of first opposable throwing knife 105 and second opposable throwing knife 155 of interlocking double throwing knife 100, as assembled, in accordance with one embodiment. Each of the components is indicated by like reference numerals to similar or the same components from FIGS. 1A-1C. Notably, each completed handle is indicated as having some stylistic design based on the combination of the exterior sheath 120/170 with the material of the underlying top handle 110/160.

Figure 3:
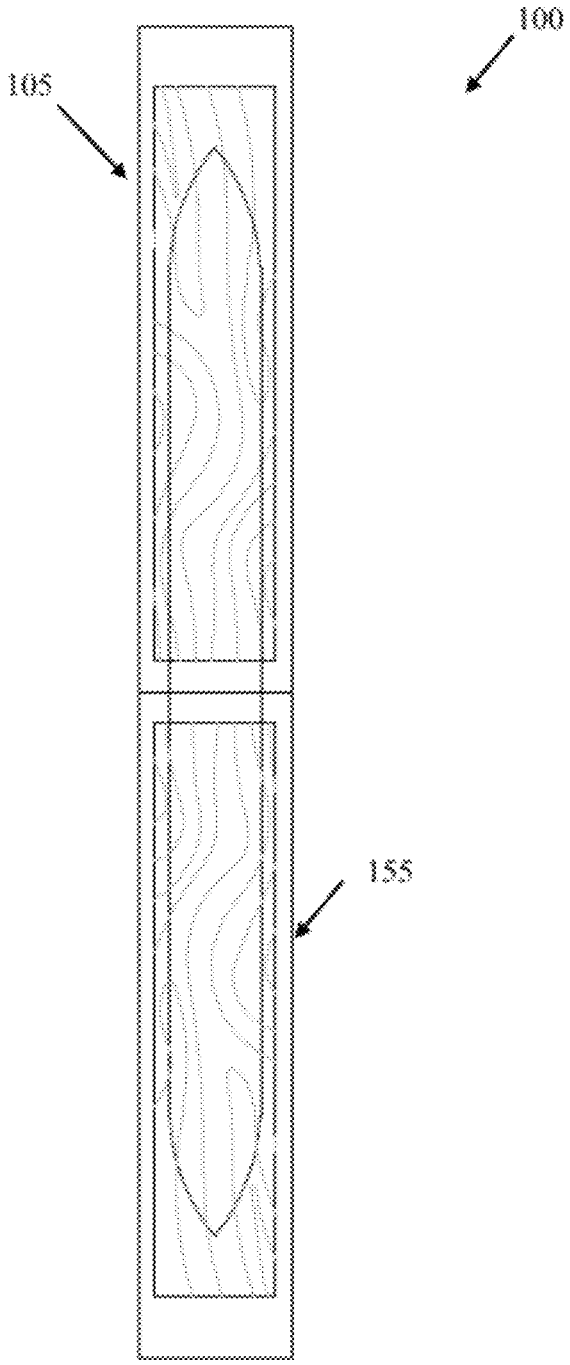
FIG. 3 is a top, lengthwise view of the first and second opposable throwing knives in an interlocked position, showing the internal position of the knife blades within the opposing handles, according to one embodiment.

FIG. 3 also illustrates a top view of interlocking double throwing knife 100, with first opposable throwing knife 105 and second opposable throwing knife 155 in the interlocked position, in accordance with one embodiment. When interlocked, the blade 125 of first opposable throwing knife 105 and the blade 175 of second opposable throwing knife 155 are sheathed within the opposing handle within the space/indentation indicated within the top handles 110/160 of each knife 105/155. In this position, the exposed end of each blade is positioned adjacent to the section of the other blade affixed to the handle of the other knife. This orientation of the blades is referred to herein as the blades (i.e., the full length) being adjacent to each other but aligned in opposite directions.

From this interlocked orientation, when the opposable throwing knives are interlocked and while only the handle of one opposable throwing knife (closest to the body of the thrower) is held by thrower, the application of a sufficient forward semi-rotational force (such as a forward throwing motion, with an applied rotation from top to bottom, bottom to top, or side to side) on the interlocked double throwing knife 100 overcomes the combined force applied by the locking mechanisms and results in the separation of the conjoined opposable throwing knife. The separated opposing throwing knife travels away from the gripped/held handle of the other throwing knife in the direction of the forward momentum or force. Notably, if the forward momentum applied to un-gripped throwing knife of the interlocked double throwing knife 100, while holding the handle of the gripped throwing knife, is insufficient to overcome the combined force applied by the locking mechanisms, first opposable throwing knife 105 and second opposable throwing knife 155 will remain interlocked.

Figure 4:
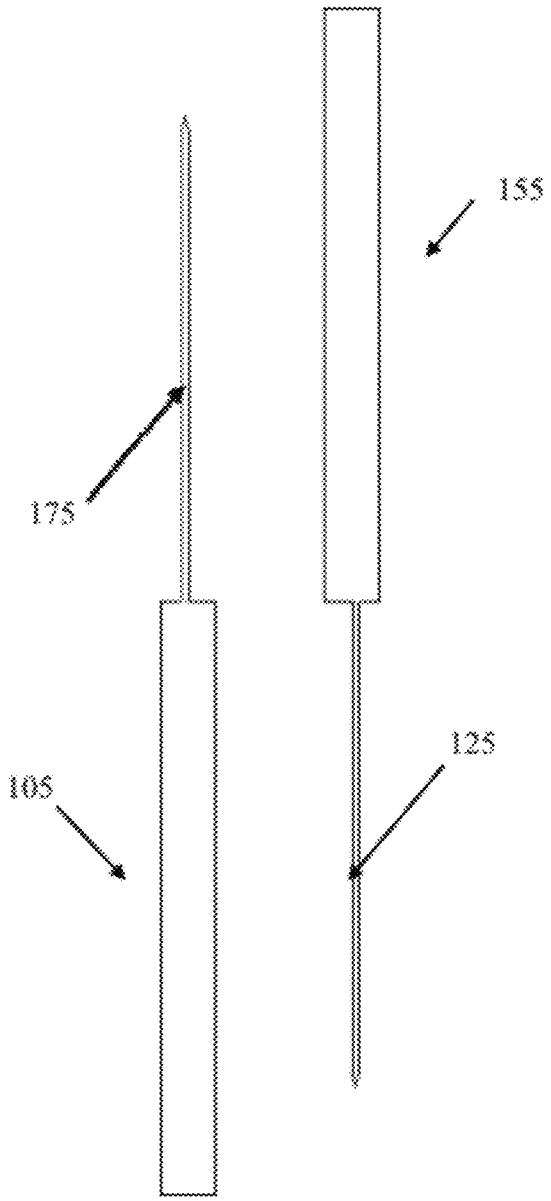
FIG. 4 is a side view of each of the first and the second opposable throwing knives of the interlocking double throwing knife, while not interlocked, according to one embodiment.

With reference now to FIG. 4, there is illustrated a side view of first opposable throwing knife 105 and second opposable throwing knife 155 of interlocking double throwing knife 100, with exposed blades adjacent to (but not inserted within) the opposing handles, in accordance with one embodiment. As illustrated, blade 125 and blade 175 are both secured slightly off center in an opposable fashion of their respective handles to allow sheathing of blade 125 within the handle of the first opposable throwing knife 105 and simultaneous sheathing of blade 175 within the handle of the second opposable throwing knife 155.

Figure 5:
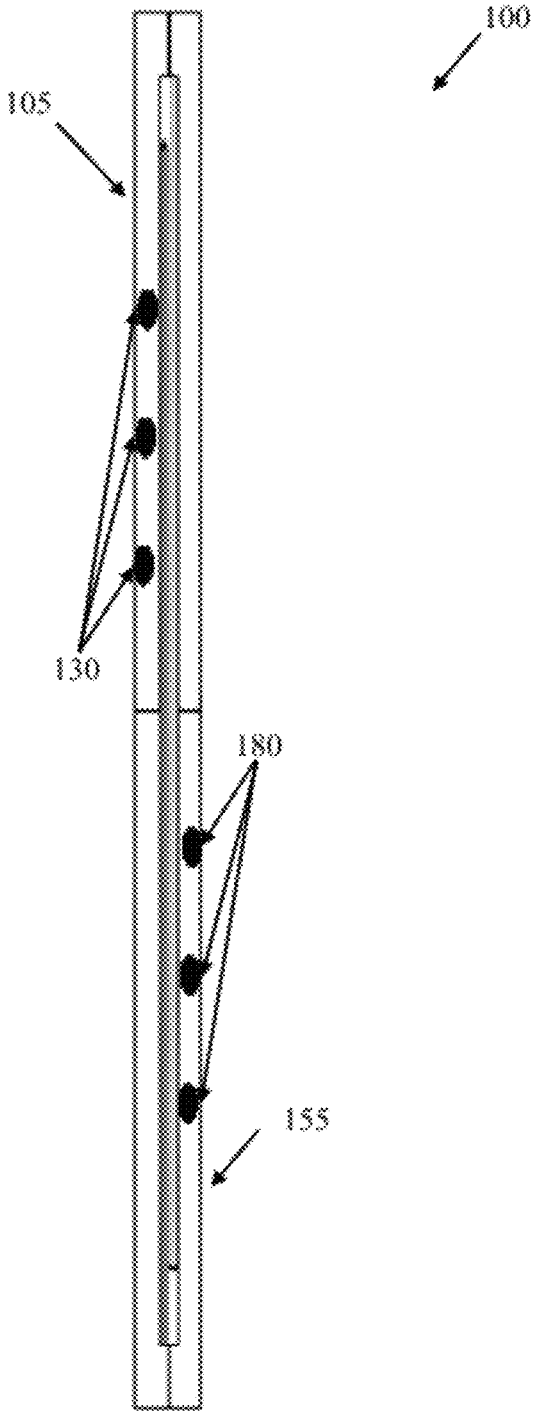
FIG. 5 is a cross-sectional side view of the first and second opposable throwing knives in an interlocked position, showing the recessed space and magnets within each knife handle to enable insertion of the opposing blade and interlocking of the knives, according to one or more embodiments.

FIG. 5 provides a cross-sectional side view of interlocking double throwing knife 100, with first opposable throwing knife 105 and second opposable throwing knife 155 in the interlocked position, in accordance with one embodiment. As shown, the exposed ends of the blades 125/175 of each knife 105/155 is inserted into the space/indentation created in the handle of the opposing knife. The ends of the respective indentations are visible at the top and bottom of the interlocking double throwing knife 100. Also visible from the cross sectional view is the slight offset of the blades relative to the center position of the respective handle to which the blade is affixed. The combination of the two blades within the interlocking double throwing knife 100 when the individual knives are interlocked provides a centered position of the combined blades relative to the entire structure. Also illustrated by FIG. 5 are the magnets that comprise the interlocking mechanisms 130/180. The magnets are embedded within each handle on the side of the handle that is proximate to the inserted blade from the opposing knife.

The schematic and exploded diagrams presented by the various figures and described herein illustrate some possible embodiments of the architecture, construction, and functionality of example interlocking double throwing knives, according to various embodiments, which are not intended to be exclusive, and which extends to all functional equivalents thereof.

Figure 6:
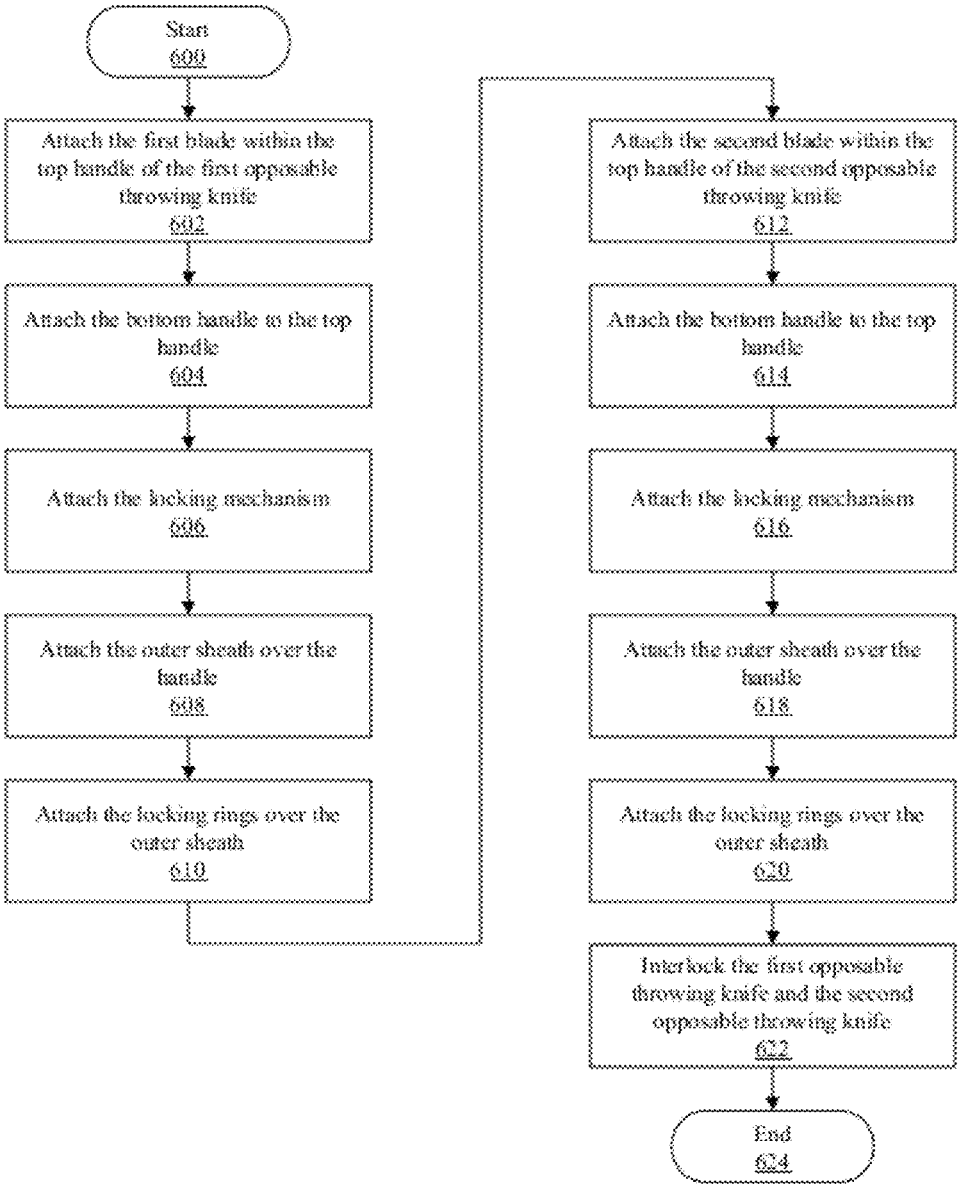
FIG. 6 is a high-level flow-chart of an exemplary method of making an interlocking double throwing knife, according to one embodiment.

Referring now to FIG. 6, a high-level flow-chart of a method by which one example interlocking double throwing knife can be manufactured, according to one embodiment. It is appreciated that multiple different processes can be employed within other embodiments to generate an interlocking double throwing knife, and that different materials can be utilized within each embodiment. The presented method covers only the basic aspects of that design and manufacturing process and is presented solely for illustration and not to imply any limitations on the actual manufacturing process that may be employed in the manufacture of any interlocking double throwing knife that fall within the scope of the general descriptions herein. Steps 602-610 represent the assembly of the first opposable throwing knife (e.g., knife 105), while similar steps 612-620 represent assembly of the second opposable throwing knife (e.g., knife 155). It is appreciated that many of the below described processes can be automated and performed by a machine, and the described method is intended to be applicable to machine automated process for completing the assembly as well as a manual human assembly and/or a hybrid of both the machine automated and manual processing. Reference can be made to the illustrations of FIGS. 1A-1C and also to FIGS. 2-5 as well, to gain a better appreciation of the assembly steps described herein.

After initiator block 600, the blade of the first opposable throwing knife is fixably attached within the bottom handle 115 of the first opposable throwing knife (block 602). The blade may be attach within the bottom handle by sliding the blade into the bottom handle (for example underneath a lip that keeps the blade secured) or by being welded into the bottom handle. Optionally, the blade may be molded as a part of the bottom handle structure. During the molding process to create the top handle 110 and the bottom handle 115, and indentation or groove is made within internal surface of the handle to allow for the insertion of the opposing blade of the second knife. The indentation or groove can be provided by creating a lip running along the exterior edges of the inner surface of the top handle 110 or the bottom handle 115, such that the interior of the lip is the right length and width to house the exposed blade of the opposing knife. The top handle 110 of FIGS. 1A-1C illustrates the exterior lip and resulting indentation or groove at the base of the top handle 110. A similar construction is made for the top handle 160 or bottom handle 165 of the second knife 155.

At block 604 the bottom handle 115 of the first opposable throwing knife 105 is attached to the top handle 110 to form the handle of the first opposable throwing knife 105. The bottom handle 115 may be attach to the top handle 110 by welding the handles together, inserting screws into holes made along the perimeter of the two handles, coupling the two handles together with an adhesive or bonding material, snapping opposing male and female connectors and receptors of both the top handle and bottom handle into each other, applying a ring or sheath around the two components in a secured fashion, or by any other securing mechanism that may be available. The actual mechanism utilized can depend on the material from which the top and bottom handles is made, in one embodiment. At block 606, the locking mechanism of the first opposable throwing knife is embedded or attached to one or both of the top handle 110 and the bottom handle 115. It is appreciated that the construction and/or assembly may involve inserting the locking mechanism prior to attaching the top handle 110 to the bottom handle 115, in one or more alternate embodiments. The outer sheath 120 is then attached to or slid over the exterior surface of the combined handle (block 608). At block 610, the locking rings are attached over the ends of and/or the top of the outer sheath, which completes the assembly of the first opposable throwing knife.

In one embodiment, the handle can also include a gripping material and/or a gripping mechanism place on or within the handle. In yet another embodiment, the handle can include a counter magnet that reduces the magnetic force whenever the handle is gripped with sufficient force by the thrower, while sufficient rotational and forward momentum is being applied to the interlocked structure.

Blocks 612-620 represent the assembly of the second opposable throwing knife, which steps are similar as those previously described as blocks 602-610. Given the similarity in the processes, certain aspects of the above description are omitted from this description. At block 612 the blade of the second opposable throwing knife is attached within the bottom handle 165 of the second opposable throwing knife. At block 614, the bottom handle 165 of the second opposable throwing knife is attached to the top handle 160 to form the handle of the second opposable throwing knife. The bottom handle 165 may attach to the top handle by any one of the aforementioned methods. At block 616 the locking mechanism 180 of the second opposable throwing knife is attached to or embedded within one or both of the top handle 160 or the bottom handle 165 of the second opposable throwing knife 155. Again, the sequence of the inclusion of the locking mechanism 180 can be changed relative to the other blocks in the method. The outer sheath 170 is then attached over the exterior surface of the combined handle (block 608). At block 620 the locking rings **185*a*, 185*n* are attached over the ends of or on top of the outer sheath 170, which completes the assembly of the second opposable throwing knife 155**.

At block 622 the first opposable throwing knife 105 and the second opposable throwing knife 155 are interlocked by inserting the exposed end of the first blade 125 into the receptacle formed by attaching the top handle 160 and bottom handle 165 of the second opposable throwing knife 155, while simultaneously inserting the second blade 175 into the receptacle formed by attaching the top handle 110 and bottom handle 115 of the first opposable throwing knife 105. The process then ends (block 624).

A user of the interlocking double throwing knife 100 can then grip any end (and by extension grip one of the first handle and a second handle respectively corresponding to a first knife 105 and the second knife 155) and apply a forward rotational momentum to the interlocking double throwing knife 100 to dislodge the non-gripped knife (i.e., the knife whose handle is not being held by the thrower and which is thus furthest away from the throwing at the end of the throwing motion). This can be achieved by making a throwing motion towards a target (requiring a combination of rotational velocity, forward momentum, precise direction, and steady release, among other characteristics of a good throw). The locking mechanism is strong enough to hold the two knives in place (via the sheathed blades) during normal carrying of the interlocking double throwing knife 100 and, in the absence of any significant forward and rotational thrust being applied to the non-gripped (second) knife while gripping the handle of the gripped (first) knife. However, the transverse force of the locking mechanism can be overcome by a sufficient transverse forced created by the forward momentum applied to the non-gripped knife, such that the forward force disengages the locking mechanism. This condition applies if the force of the forward momentum is greater than the force applied by the locking mechanism(s) to interlock the first opposable throwing knife and the second opposable throwing knife together. If the forward momentum is not great enough to overcome the transverse force applied by the locking mechanism(s) and dislodge the non-gripped knife, then the interlocking of the first opposable throwing knife and the second opposable throwing knife is maintained. However, when the forward momentum is sufficient to overcome the locking force of the interlocking mechanism and dislodge the non-gripped knife, the non-gripped knife travels in a lateral direction towards the intended target. It is appreciated that some level of skill and practice is required for the interlocking double throwing knife 100 to have the intended accuracy and result in the impaling of the intended target by the exposed blade when thrown at the target.

Thus, as presented by the above descriptions, the present disclosure provides an interlocking double throwing knife comprising: a first opposable throwing knife, the first opposable throwing knife having a first blade and a first handle attached to the first blade, where the first handle has a first receptacle for housing another blade; and a second opposable throwing knife, the second opposable throwing knife having a second blade and a second handle attached to the second blade, where the second handle has a second receptacle for housing another blade. The first opposable throwing knife and the second opposable throwing knife interlock by simultaneously inserting the first blade into the second receptacle and the second blade into the first receptacle such that the first blade and the second blade are sheathed within opposing knife handles. Also, at least one of the first opposable throwing knife and the second opposable throwing knife has a locking mechanism for maintaining the interlocking of the first opposable throwing knife and the second opposable throwing knife. The locking mechanism applies a force that secures the first opposable throwing knife and the second opposable throwing knife in the interlocked position until a sufficient force is applied to dislodge the first knife from the second knife.

In one embodiment, at least one of the first blade and the second blade are manufactured from a ferrous material and the locking mechanism comprises one or more magnets. The one or more magnets are embedded in at least one of the first handle and the second handle within which the at least one of the first blade and the second blade made of ferrous material is sheathed, wherein the one or more magnets exert a magnetic force on the sheathed blade to keep the blade in a sheathed position until the sufficient force is applied.

In another embodiment, the locking mechanism is a safety latch comprising a male component and a female component. The male component of the latch is attached to the handle in a first of the first opposable throwing knife and the second opposable throwing knife and a female component of the latch is attached to the handle in a next one of the first opposable throwing knife and the second opposable throwing knife. In another embodiment, the locking mechanism is a safety latch comprising a male component and a female component. The male component of the latch is embodied within a first one of the first handle and the second handle and a female component of the latch is embodied within a next one of the first handle and the second handle.

According to the described embodiments, the locking mechanism is configured to: in response to a user holding the first handle of the first opposable throwing knife and applying a forward momentum to the interlocking double throwing knife while the second opposable throwing knife is interlocked with the first opposable throwing knife: (a) disengage the locking mechanism if the forward momentum is of sufficient force to overcome a force applied by the locking mechanism; and (b) maintain the interlocking of the locking mechanism if the forward momentum does not provide sufficient force to overcome the force applied by the locking mechanism.

The embodiments also provide a method of making the interlocking double throwing knife. Within the presented method and the resulting assembled knife, the first blade is positioned off center relative to a width of the first handle and the second blade is also positioned off-center relative to a width of the second handle. The first receptacle within the first handle is located laterally adjacent to a handle portion of the first blade at a position corresponding to the off-center position of the second blade, while the second receptacle within the second handle is located laterally adjacent to a handle portion of the second blade at a position corresponding to the off-center position of the first blade.

While the invention has been described with reference to exemplary embodiments, it will be understood by those skilled in the art that various changes may be made and equivalents may be substituted for elements thereof without departing from the scope of the invention. In addition, many modifications may be made to the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An interlocking double throwing knife comprising:

a first opposable throwing knife, the first opposable throwing knife having:

a first blade; and a first handle attached to the first blade, wherein the first handle has a first receptacle for housing another blade; and a second opposable throwing knife, the second opposable throwing knife having:

a second blade;

a second handle attached to the second blade, wherein the second handle has a second receptacle for housing another blade;

wherein the first opposable throwing knife and the second opposable throwing knife interlock by simultaneously inserting the first blade into the second receptacle and the second blade into the first receptacle such that the first blade and the second blade are sheathed within opposing knife handles;

at least one interlocking mechanism associated with at least one of the first opposable throwing knife and the second opposable throwing knife, the interlocking mechanism for maintaining the interlocking of the first opposable throwing knife and the second opposable throwing knife;

wherein each of the first handle and the second handle comprises: a top handle including the interlocking mechanism; and a bottom handle fixably and permanently attached to the top handle, wherein the bottom handle has the blade securely attached thereto; and an outer sheath that is placed over the top handle and the bottom handle, wherein the outer sheath is secured over the top handle and the bottom handle and provides additional grip and aesthetics to a respective one of the first handle and the second handle.

2. The interlocking double throwing knife of claim 1, wherein at least one of the first blade and the second blade is manufactured from a ferrous material and the interlocking mechanism comprises one or more magnets.

3. The interlocking double throwing knife of claim 2, wherein the one or more magnets are embedded in at least one of the first handle and the second handle within which the at least one of the first blade and the second blade made of ferrous material is sheathed, wherein the one or more magnets exert a magnetic force on the sheathed blade to keep the blade in a sheathed position until the sufficient force is applied.

4. The interlocking double throwing knife of claim 2, wherein the one or more magnets is a single magnetic strip attached inside at least one of the first receptacle and the second receptacle.

5. The interlocking double throwing knife of claim 2, wherein the one or more magnets is attached to a handle portion of at least one of the first blade and the second blade.

6. The interlocking double throwing knife of claim 1, wherein the interlocking mechanism is a safety latch comprising a male component and a female component, wherein the male component of the latch is attached to the handle in a first of the first opposable throwing knife and the second opposable throwing knife and the female component of the latch is attached to the handle in a next one of the first opposable throwing knife and the second opposable throwing knife.

7. The interlocking double throwing knife of claim 1, wherein the interlocking mechanism is a safety latch comprising a male component and a female component, wherein the male component of the latch is embodied within the first one of the first handle and the second handle and a female component of the latch is embodied within a next one of the first handle and the second handle.

8. The interlocking double throwing knife of claim 1, wherein the first blade is welded to the first handle and the second blade is welded to the second handle.

9. The interlocking double throwing knife of claim 1, wherein the first blade and the first handle are a single piece of molded metal and the second blade and the second handle are a single piece of molded metal.

10. The interlocking double throwing knife of claim 1, wherein the first blade is positioned off-center relative to a width of the first handle and the second blade is also positioned off-center relative to a width of the second handle and wherein the first receptacle within the first handle is located laterally adjacent to a handle portion of the first blade at a position corresponding to the off-center position of the second blade, while the second receptacle within the second handle is located laterally adjacent to a handle portion of the second blade at a position corresponding to the off-center position of the first blade.

11. A method of making the first opposable throwing knife of claim 1, the method comprising attaching the first blade to the first handle; and providing the first receptacle within the first handle.

12. A method of making the interlocking double throwing knife of claim 1, the method comprising: attaching the first blade to the first handle and providing the first receptacle within the first handle; attaching the second blade to the second handle and providing the second receptacle within the second handle; and respectively inserting the first blade and the second blade into the opposing second receptacle and first receptacle.

13. The method of claim 12, further comprising positioning the first blade off-center relative to a width of the first handle and positioning the second blade off-center relative to a width of the second handle, wherein the first receptacle within the first handle is located laterally adjacent to a handle portion of the first blade at a position corresponding to the off-center position of the second blade, while the second receptacle within the second handle is located laterally adjacent to a handle portion of the second blade at a position corresponding to the off-center position of the first blade.

14. The method of claim 12, further comprising providing the interlocking mechanism with at least one of the first opposable throwing knife and the second opposable throwing knife for maintaining the interlocking of the first opposable throwing knife and the second opposable throwing knife, wherein the interlocking mechanism applies a force that secures the first opposable throwing knife and the second opposable throwing knife in the interlocked position until a sufficient force is applied to dislodge the first knife from the second knife.

15. The method of claim 14, further comprising manufacturing at least one of the first blade and the second blade from a ferrous material and wherein the interlocking mechanism comprises one or more magnets.

16. The method of claim 15, further comprising embedding the one or more magnets in at least one of the first handle and the second handle within which the at least one of the first blade and the second blade made of ferrous material is sheathed, wherein the one or more magnets exert a magnetic force on the sheathed blade to keep the blade in a sheathed position until the sufficient force is applied.

17. The method of claim 15, further comprising configuring the interlocking mechanism to: in response to a user holding the first handle of the first opposable throwing knife and applying a forward momentum to the interlocking double throwing knife while the second opposable throwing knife is interlocked with the first opposable throwing knife: (a) disengage the locking mechanism if the forward momentum is of sufficient force to overcome a force applied by the locking mechanism; and (b) maintain the interlocking of the locking mechanism if the forward momentum does not provide sufficient force to overcome the force applied by the locking mechanism.

18. An interlocking double throwing knife comprising:

a first opposable throwing knife, the first opposable throwing knife having:

a first blade; and a first handle attached to the first blade, wherein the first handle has a first receptacle for housing another blade; and a second opposable throwing knife, the second opposable throwing knife having:

a second blade;

a second handle attached to the second blade, wherein the second handle has a second receptacle for housing another blade;

wherein the first opposable throwing knife and the second opposable throwing knife interlock by simultaneously inserting the first blade into the second receptacle and the second blade into the first receptacle such that the first blade and the second blade are sheathed within opposing knife handles;

at least one interlocking mechanism associated with at least one of the first opposable throwing knife and the second opposable throwing knife, the interlocking mechanism for maintaining the interlocking of the first opposable throwing knife and the second opposable throwing knife;

wherein each of the first handle and the second handle comprises:

a top handle, wherein the interlocking mechanism is included within the top handle; and a bottom handle fixably and permanently attached to the top handle, wherein the bottom handle has the blade securely attached thereto; and wherein the top handle and the bottom handle are secured together by one or more locking rings attach over an outer sheath.

19. The interlocking double throwing knife of claim 18, wherein the top handle and the bottom handle are welded together.

20. The interlocking double throwing knife of claim 18, wherein the top handle and the bottom handle are secured together with one or more screws.

21. The interlocking double throwing knife of claim 18, wherein the top handle and the bottom handle are secured together with an epoxy or other bonding material.

22. The interlocking double throwing knife of claim 18, wherein the outer sheath is placed over the top handle and the bottom handle, wherein the outer sheath is secured over the top handle and the bottom handle and provides additional grip and aesthetics to a respective one of the first handle and the second handle.

23. The interlocking double throwing knife of claim 18, wherein the one or more locking rings are magnetic and create the interlocking mechanism.

24. The interlocking double throwing knife of claim 18, wherein the top handle and the bottom handle are constructed from a different material than the respective one of the first blade and the second blade.

25. A method of making the interlocking double throwing knife of claim 18, the method comprising: attaching the first blade to the first handle and providing the first receptacle within the first handle; attaching the second blade to the second handle and providing the second receptacle within the second handle; and respectively inserting the first blade and the second blade into the opposing second receptacle and first receptacle.

26. The method of claim 25, further comprising providing the interlocking mechanism with at least one of the first opposable throwing knife and the second opposable throwing knife for maintaining the interlocking of the first opposable throwing knife and the second opposable throwing knife, wherein the interlocking mechanism is designed to apply a force that secures the first opposable throwing knife and the second opposable throwing knife in the interlocked position until a sufficient lateral force is applied to dislodge the first knife from the second knife and the interlocking mechanism enables: (i) disengagement of the first knife to cause the first knife to travel in a forward direction, in response to a forward momentum of sufficient force to overcome a force applied by the interlocking mechanism being applied while a user holds the second handle; and (ii) maintenance of the interlocking if the forward momentum applied does not provide sufficient force to overcome the force applied by the interlocking mechanism.

* * * * *